US006790913B2

(12) United States Patent
Deneker et al.

(10) Patent No.: US 6,790,913 B2
(45) Date of Patent: Sep. 14, 2004

(54) ADDITIVE COMPOSITIONS

(75) Inventors: Vincent J. P. R. Deneker, Frilford Heath (GB); Paul Harffey, Oxford (GB)

(73) Assignee: Infineum International Ltd. (GB)

( * ) Notice: Subject to any disclaimer, the term of this patent is extended or adjusted under 35 U.S.C. 154(b) by 69 days.

(21) Appl. No.: 10/266,075

(22) Filed: Oct. 7, 2002

(65) Prior Publication Data

US 2003/0119992 A1 Jun. 26, 2003

(30) Foreign Application Priority Data

Oct. 15, 2001 (GB) ..... 0124676
Oct. 25, 2001 (EP) ..... 01309085

(51) Int. Cl.[7] ..... C08F 297/00; C08F 8/04; C10L 1/18; C10L 1/14

(52) U.S. Cl. ..... 525/314; 525/98; 525/338; 508/475; 508/591; 44/393; 44/395

(58) Field of Search ..... 525/314, 98, 338, 525/308, 309; 508/475, 591; 44/393, 395

(56) References Cited

FOREIGN PATENT DOCUMENTS

WO WO96/28523 9/1996 ..... C01L/1/16

*Primary Examiner*—James J. Seidleck
*Assistant Examiner*—Olga Asinovsky

(57) ABSTRACT

Additive compositions comprising:

(i) at least one oil-soluble hydrogenated block diene polymer, comprising at least one crystallizable block, obtainable by end-to-end polymerization of a linear diene, and at least one non-crystallizable block, the non-crystallizable block being obtainable by 1,2-configuration polymerization of a linear diene, by polymerization of a branched diene, or by a mixture of such polymerizations, (ii) at least one ethylene-unsaturated ester compound; and (iii) at least one comb polymer.

The additive compositions are used to improve cold flow characteristics in fuel oils. The additive compositions are particularly effective in fuel oils having a 90–20% boiling temperature range, as measured in accordance with ASTM D-86, of more than 115° C., preferably more than 120° C., more preferably more than 130° C., and most preferably more than 140° C., and a final boiling point of more than 370° C., preferably more than 380° C., and most preferably more than 390° C.

10 Claims, No Drawings

ADDITIVE COMPOSITIONS

This invention relates to additive compositions, use of the additive compositions to improve cold flow characteristics of fuel oils, fuel oil compositions comprising the additive compositions and additive concentrates of the additive compositions.

Fuel oils, whether derived from petroleum or from vegetable sources, contain components, e.g., alkanes, that at low temperature tend to precipitate as large crystals or spherulites of wax in such a way as to form a gel structure which causes the fuel to lose its ability to flow. The lowest temperature at which the fuel will still flow is known as the pour point.

As the temperature of the fuel falls and approaches the pour point, difficulties arise in transporting the fuel through lines and pumps. Further, the wax crystals tend to plug fuel lines, screens, and filters at temperatures above the pour point. These problems are well recognized in the art, and various additives have been proposed, many of which are in commercial use, for depressing the pour point of fuel oils. Similarly, other additives have been proposed and are in commercial use for reducing the size and changing the shape of the wax crystals that do form. Smaller size crystals are desirable since they are less likely to clog a filter. The wax from a diesel fuel, which is primarily an alkane wax, crystallizes as platelets; certain additives inhibit this and cause the wax to adopt an acicular habit, the resulting needles being more likely to pass through a filter than are platelets. The additives may also have the effect of retaining in suspension in the fuel the crystals that have formed, the resulting reduced settling also assisting in prevention of blockages.

EP 0 815 184A discloses the use of an oil-soluble hydrogenated block diene polymer in combination with a cold flow improver selected from: ethylene-unsaturated ester compounds; comb polymers; polar nitrogen compounds; compounds comprising a ring system having at least two substituents comprising a linear or branched aliphatic hydrocarbylene group optionally interrupted by one or more hetero atoms and carrying a secondary amino group, the substituents on the amino groups each being a hydrocarbyl group containing 9 to 40 carbons; hydrocarbon polymers; and polyoxyalkylene compounds.

The present invention is concerned with the problem of providing an improved additive composition for improving cold flow characteristics of fuel oils.

More particularly, the present invention is concerned with the problem of improving cold flow characteristics of fuel oils having a 90%–20% boiling temperature range, as measured in accordance with ASTM D-86, of more than 115° C., preferably more than 120° C., more preferably more than 130° C., and most preferably more than 140° C., and a final boiling point of more than 370° C., preferably more than 380° C., and most preferably more than 390° C.

In accordance with the present invention there is provided an additive composition comprising:

(i) at least one oil-soluble hydrogenated block diene polymer, comprising at least one crystallizable block, obtainable by end-to-end polymerization of a linear diene, and at least one non-crystallizable block, the non-crystallizable block being obtainable by 1,2-configuration polymerization of a linear diene, by polymerization of a branched diene, or by a mixture of such polymerizations;
(ii) at least one ethylene-unsaturated ester compound; and
(iii) at least one comb polymer.

As used in this specification the term "hydrocarbon" and related terms refer to a group having a hydrocarbon or predominantly hydrocarbon character. Among these, there may be mentioned hydrocarbon groups, including aliphatic, (e.g., alkyl), alicyclic (e.g., cycloalkyl), aromatic, aliphatic and alicyclic-substituted aromatic, and aromatic-substituted aliphatic and alicyclic groups. Aliphatic groups are advantageously saturated. These groups may contain non-hydrocarbon substituents provided their presence does not alter the predominantly hydrocarbon character of the group. Examples include keto, halo, hydroxy, nitro, cyano, alkoxy and acyl. The groups may also or alternatively contain atoms other than carbon in a chain or ring otherwise composed of carbon atoms.

The invention also provides use of the additive composition defined above to improve cold flow characteristics of a fuel oil. The additive composition has been found to be particularly effective in fuel oils having a 90%–20% boiling temperature range, as measured in accordance with ASTM D-86, of more than 115° C., preferably more than 120° C., more preferably more than 130° C., and most preferably more than 140° C., and a final boiling point of more than 370° C., preferably more than 380° C., and most preferably more than 390° C.

The invention further provides a fuel oil composition comprising a major proportion of a fuel oil and a minor proportion of the additive composition defined above.

The invention still further provides an additive concentrate comprising a solvent miscible with fuel oil and a minor proportion of the additive composition defined above.

Advantageously, the hydrogenated block copolymer used in the present invention comprises at least one substantially linear crystallizable segment or block and at least one segment or block that is essentially not crystallizable. Without wishing to be bound by any theory, it is believed that when butadiene is homopolymerized with a sufficient proportion of 1,4 (or end-to-end) enchainments to provide a substantially linear polymeric structure then on hydrogenation it resembles polyethylene and crystallizes rather readily; when a branched diene is polymerized on its own or with butadiene a branched structure will result (e.g., a hydrogenated polyisoprene structure will resemble an ethylene-propylene copolymer) that will not readily form crystalline domains but will confer fuel oil solubility on the block copolymer.

Advantageously, the block copolymer before hydrogenation comprises units derived from butadiene only, or from butadiene and at least one comonomer of the formula $$CH_2{=}CR^1{-}CR^2{=}CH_2$$

wherein $R^1$ represents a $C_1$ to $C_8$ alkyl group and $R^2$ represents hydrogen or a $C_1$ to $C_8$ alkyl group. Advantageously the total number of carbon atoms in the comonomer is 5 to 8, and the comonomer is advantageously isoprene. Advantageously, the copolymer contains at least 10% by weight of units derived from butadiene.

After hydrogenation, the copolymer advantageously contains at least 10%, preferably at least 15% by weight, and preferably at most 40% by weight, most preferably at most 35% by weight, of at least one crystalline or crystallizable segment composed primarily of methylene units; to this end the crystallizable segment before hydrogenation advantageously has an average 1,4 or end-to-end enchainment of at least 70 mole, preferably at least 85 mole, per cent. The hydrogenated block copolymer comprises at least one low crystallinity segment composed of methylene and substituted methylene units, derived from one or more alkyl-substituted monomers described above, e.g., isoprene and 2-3-dimethylbutadiene.

Alternatively, the low crystallinity segment may be derived from butadiene by 1,2 enchainment, in which the segment has before hydrogenation an average 1,4 enchainment of butadiene of at most 30, preferably at most 10, percent. As a result, the polymer comprises 1,4-polybutadiene as one block and 1,2-polybutadiene as another. Such polymers are obtainable by e.g., adding a catalyst modifier, as described in WO92/16568.

A further advantageous block copolymer is a star copolymer having from 3 to 25, preferably 5 to 15, arms.

Advantageous embodiments of block copolymers are those comprising a single crystallizable block and a single non-crystallizable block and those comprising a single non-crystallizable block having at each end a single crystallizable block. Other tri- and tetra-block copolymers are also available. In certain preferred embodiments, in which the copolymer is derived from butadiene and isoprene, these are referred to below as PE-PEP and PE-PEP-PE copolymers respectively.

In general, the crystallizable block or blocks will be the hydrogenation product of the unit resulting from predominantly 1,4- or end-to-end polymerization of butadiene, while the non-crystallizable block or blocks will be the hydrogenation product of the unit resulting from 1,2-polymerization of butadiene or from 1,4-polymerization of an alkyl-substituted butadiene.

Advantageously the molecular weight, Mn, of the hydrogenated block copolymer, measured by GPC, lies in the range of 500 to 100,000, more advantageously 500 to 20,000, and most preferably 500 to 10,000.

Advantageously, in a diblock polymer, the molecular weight of the crystallizable block is from 500 to 20,000, and preferably from 500 to 5,000, and that of the noncrystallizable block is from 500 to 50,000, preferably from 5,000 to 11,000. In a triblock polymer, the molecular weight of each crystallizable block is advantageously from 500 to 20,000, advantageously about 5,000, and that of the non-crystallizable block is from 1,000 to 20,000, preferably 1,000 to 5,000.

The proportion of the total molecular weight of a block copolymer represented by a crystalline block or blocks may be determined by H or C NMR, and the total molecular weight of the polymer by GPC.

The precursor block copolymers are conveniently prepared by anionic polymerization, which facilitates control of structure and molecular weight, preferably using a metallic or organometallic catalyst. Hydrogenation is effected employing conventional procedures, using elevated temperature and hydrogen pressure in the presence of a hydrogenation catalyst, preferably palladium on barium sulphate or calcium carbonate or nickel octanoate/triethyl aluminium.

Advantageously, at least 90% of the original unsaturation (as measured by NMR spectroscopy) is removed on hydrogenation, preferably at least 95%, and more preferably at least 98%.

The fuel oil may be, e.g., a petroleum-based fuel oil, especially a middle distillate fuel oil. Such distillate fuel oils generally boil within the range of from 110° C. to 500° C., e.g. 150° C. to 400° C.

The invention is applicable to middle distillate fuel oils of all types, including the broad-boiling distillates, i.e., those having a 90%–20% boiling temperature difference, as measured in accordance with ASTM D-86, of 100° C. or more.

The invention is particularly applicable to middle distillate fuel oils having: a 90%–20% boiling temperature difference, as measured in accordance with ASTM D-86, of more than 115° C., preferably more than 120° C., more preferably more than 130° C., and most preferably more than 140° C.; optionally an FBP (final boiling point)—90% boiling temperature difference of less than 30° C.; and a final boiling point of 370° C. or more, preferably 380° C. or more, and most preferably 390° C. or more.

The fuel oil may comprise atmospheric distillate or vacuum distillate, cracked gas oil, or a blend in any proportion of straight run and thermally and/or catalytically cracked distillates. The most common petroleum distillate fuels are kerosene, jet fuels, diesel fuels, heating oils and heavy fuel oils. The heating oil may be a straight atmospheric distillate, or may also contain vacuum gas oil or cracked gas oil or both. The above mentioned low temperature flow problem is most usually encountered with diesel fuels and with heating oils. The invention is also applicable to vegetable-based fuel oils, for example, rape seed oil, used alone or in admixture with a petroleum distillate oil.

The compositions of the invention are also useful in fuel oils having a relatively high wax content, e.g., a wax content above 1% by weight at 10° C. below cloud point.

The compositions should preferably be soluble in the oil to the extent of at least 500 ppm by weight per weight of oil at ambient temperature. Less soluble compositions may cause filter blocking problems in the absence of wax. The "Navy Rig" test is used to establish whether a composition is likely to cause such problems.

The ethylene-unsaturated ester copolymer preferably includes, in addition to units derived from ethylene, units of the formula $$—CR^3R^4—CHR^5—$$

wherein $R^3$ represents hydrogen or methyl, $R^4$ represents $COOR^6$, wherein $R^6$ represents an alkyl group having from 1 to 9 carbon atoms, which is straight chain or, if it contains 3 or more carbon atoms, branched, or $R^4$ represents $OOCR^7$, wherein $R^7$ represents $R^6$ or H, and $R^5$ represents H or $COOR^6$.

These may comprise a copolymer of ethylene with an ethylenically unsaturated ester, or derivatives thereof. An example is a copolymer of ethylene with an ester of a saturated alcohol and an unsaturated carboxylic acid, but preferably the ester is one of an unsaturated alcohol with a saturated carboxylic acid.

As disclosed in U.S. Pat. No. 3,961,916, flow improver compositions may comprise a wax growth arrestor and a nucleating agent. Without wishing to be bound by any theory, the applicants believe that component (i) of the additive composition of the invention acts primarily as a nucleator and will benefit from the presence of an arrestor. This may, for example, be an ethylene-unsaturated ester as described above, especially an EVAC with a molecular weight (Mn, measured by gel permeation chromatography against a polystyrene standard) of at most 14,000, advantageously at most 10,000, preferably 2,000 to 6,000, and more preferably from 2,000 to 5,500, and an ester content of 7.5% to 35%, preferably from 10 to 20, and more preferably from 10 to 17, molar percent.

It is within the scope of the invention to include an additional nucleator, e.g., an ethylene-unsaturated ester, especially vinyl acetate, copolymer having a number average molecular weight in the range of 1,200 to 20,000, and a vinyl ester content of 0.3 to 10, advantageously 3.5 to 7.0 molar per cent.

The comb polymer preferably includes branches containing hydrocarbyl groups pendant from a polymer backbone, and are discussed in "Comb-Like Polymers. Structure and Properties", N. A. Platé and V. P. Shibaev, J. Poly. Sci. Macromolecular Revs., 8, p 117 to 253 (1974).

Generally, comb polymers have one or more long chain hydrocarbyl branches, e.g., oxyhydrocarbyl branches, normally having from 10 to 30 carbon atoms, pendant from a polymer backbone, said branches being bonded directly or indirectly to the backbone. Examples of indirect bonding include bonding via interposed atoms or groups, which bonding can include covalent and/or electrovalent bonding such as in a salt.

Advantageously, the comb polymer is a homopolymer or a copolymer having at least 25 and preferably at least 40, more preferably at least 50, molar per cent of the units of which have, side chains containing at least 6, and preferably at least 10, atoms.

As examples of preferred comb polymers there may be mentioned those of the general formula

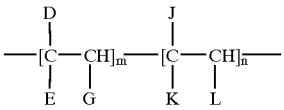

wherein D=$R^8$, $COOR^8$, $OCOR^8$, $R^9COOR^8$, or $OR^8$,

E=H, $CH_3$, D, or $R^9$,

G=H or D

J=H, $R^9$, $R^9COOR^8$, or an aryl or heterocyclic group,

K=H, $COOR^9$, $OCOR^9$, $OR^9$ or COOH,

L=H, $R^9$, $COOR^9$, $OCOR^9$, COOH, or aryl, $R^8 \geqq C_{10}$ hydrocarbyl, $R^9 \geqq C_1$ hydrocarbyl or hydrocarbylene, and m and n represent mole fractions, m being finite and preferably within the range of from 1.0 to 0.4, n being less than 1 and preferably in the range of from 0 to 0.6.

$R^8$ advantageously represents a hydrocarbyl group with from 10 to 30 carbon atoms, while $R^9$ advantageously represents a hydrocarbyl or hydrocarbylene group with from 1 to 30 carbon atoms.

The comb polymer may contain units derived from other monomers if desired or required.

These comb polymers may be copolymers of maleic anhydride or fumaric or itaconic acids and another ethylenically unsaturated monomer, e.g., an α-olefin, including styrene, or an unsaturated ester, for example, vinyl acetate or homopolymer of fumaric or itaconic acids. It is preferred but not essential that equimolar amounts of the comonomers be used although molar proportions in the range of 2 to 1 and 1 to 2 are suitable. Examples of olefins that may be copolymerized with e.g., maleic anhydride, include 1-decene, 1-dodecene, tetradecene, 1-hexadecene, and 1-octadecene.

The acid or anhydride group of the comb polymer may be esterified by any suitable technique and although preferred it is not essential that the maleic anhydride or fumaric acid be at least 50% esterified. Examples of alcohols which may be used include n-decan-1-ol, n-dodecan-1-ol, n-tetradecan-1-ol, n-hexadecan-1-ol, and n-octadecan-1-ol. The alcohols may also include up to one methyl branch per chain, for example, 1-methylpentadecan-1-ol or 2-methyltridecan-1-ol. The alcohol may be a mixture of normal and single methyl branched alcohols.

It is preferred to use pure alcohols rather than the commercially available alcohol mixtures but if mixtures are used the $R^9$ refers to the average number of carbon atoms in the alkyl group; if alcohols that contain a branch at the 1 or 2 positions are used $R^9$ refers to the straight chain backbone segment of the alcohol.

These comb polymers may especially be fumarate or itaconate polymers and copolymers such as, for example, those described in EP-A-153176, EP-A-153177 and EP-A-225688, and WO 91/16407.

Particularly preferred fumarate comb polymers are copolymers of alkyl fumarates and vinyl acetate, in which the alkyl groups have from 12 to 20 carbon atoms, more especially polymers in which the alkyl groups have 14 carbon atoms or in which the alkyl groups are a mixture of $C_{14}/C_{16}$ alkyl groups, made, for example, by solution copolymerizing an equimolar mixture of fumaric acid and vinyl acetate and reacting the resulting copolymer with the alcohol or mixture of alcohols, which are preferably straight chain alcohols. When the mixture is used it is advantageously a 1:1 by weight mixture of normal $C_{14}$ and $C_{16}$ alcohols. Furthermore, mixtures of the $C_{14}$ ester with the mixed $C_{14}/C_{16}$ ester may advantageously be used. In such mixtures, the ratio of $C_{14}$ to $C_{14}/C_{16}$ is advantageously in the range of from 1:1 to 4:1, preferably 2:1 to 7:2, and most preferably about 3:1, by weight. The particularly preferred comb polymers are those having a number average molecular weight, as measured by vapour phase osmometry, of 1,000 to 100,000, more especially 1,000 to 30,000.

Other suitable comb polymers are the polymers and copolymers of α-olefins and esterified copolymers of styrene and maleic anhydride, and esterified copolymers of styrene and fumaric acid; mixtures of two or more comb polymers may be used in accordance with the invention and, as indicated above, such use may be advantageous. Other examples of comb polymers are hydrocarbon polymers, e.g., copolymers of ethylene and at least one α-olefin, the α-olefin preferably having at most 20 carbon atoms, examples being n-decene-1 and n-dodecene-1. Preferably, the number average molecular weight of such a copolymer is at least 30,000 measured by GPC. The hydrocarbon copolymers may be prepared by methods known in the art, for example using a Ziegler type catalyst.

Optionally, the additive composition may include polar nitrogen compounds. Such compounds are oil-soluble polar nitrogen compounds carrying one or more, preferably two or more, substituents of the formula $>NR^{10}$, where $R^{10}$ represents a hydrocarbyl group containing 8 to 40 atoms, which substituent or one or more of which substituents may be in the form of a cation derived therefrom. The oil soluble polar nitrogen compound is generally one capable of acting as a wax crystal growth inhibitor in fuels. It comprises for example one or more of the following compounds:

An amine salt and/or amide formed by reacting at least one molar proportion of a hydrocarbyl-substituted amine with a molar proportion of a hydrocarbyl acid having from 1 to 4 carboxylic acid groups or its anhydride, the substituent(s) of formula $>NR^{10}$ being of the formula $—NR^{10}R^{11}$ where $R^{10}$ is defined as above and $R^{11}$ represents hydrogen or $R^{10}$, provided that $R^{10}$, and $R^{11}$ may be the same or different, said substituents constituting part of the amine salt and/or amide groups of the compound.

Ester/amides may be used, containing 30 to 300, preferably 50 to 150, total carbon atoms. These nitrogen compounds are described in U.S. Pat. No. 4,211,534. Suitable amines are predominantly $C_{12}$ to $C_{40}$ primary, secondary, tertiary or quaternary amines or mixtures thereof but shorter chain amines may be used provided the resulting nitrogen compound is oil soluble, normally containing about 30 to 300 total carbon atoms. The nitrogen compound preferably contains at least one straight chain $C_8$ to $C_{40}$, preferably $C_{14}$ to $C_{24}$, alkyl segment.

Suitable amines include primary, secondary, tertiary or quaternary, but are preferably secondary. Tertiary and quaternary amines only form amine salts. Examples of amines include tetradecylamine, cocoamine, and hydrogenated tallow amine. Examples of secondary amines include dioctacedyl amine and methylbehenyl amine. Amine mixtures are also suitable such as those derived from natural materials. A preferred amine is a secondary hydrogenated tallow amine, the alkyl groups of which are derived from hydrogenated tallow fat composed of approximately 4% $C_{14}$, 31% $C_{16}$, and 59% $C_{18}$.

Examples of suitable carboxylic acids and their anhydrides for preparing the nitrogen compounds include ethylenediamine tetraacetic acid, and carboxylic acids based on cyclic skeletons, e.g., cyclohexane-1,2-di-carboxylic acid, cyclohexene-1,2-dicarboxylic acid, cyclopentane-1,2-dicarboxylic acid and naphthalene dicarboxylic acid, and 1,4-dicarboxylic acids including dialkyl spirobislactones. Generally, these acids have about 5 to 13 carbon atoms in the cyclic moiety. Preferred acids useful in the present invention are benzene dicarboxylic acids e.g., phthalic acid, isophthalic acid, and terephthalic acid. Phthalic acid and its anhydride are particularly preferred. The particularly preferred compound is the amide-amine salt formed by reacting 1 molar portion of phthalic anhydride with 2 molar portions of dihydrogenated tallow amine. Another preferred compound is the diamide formed by dehydrating this amide-amine salt.

Other examples are long chain alkyl or alkylene substituted dicarboxylic acid derivatives such as amine salts of monoamides of substituted succinic acids, examples of which are known in the art and described in U.S. Pat. No. 4,147,520, for example. Suitable amines may be those described above.

Other examples are condensates, for example, those described in EP-A-327427.

Optionally, the additive composition may include a compound containing a cyclic ring system carrying at least two substituents of the general formula below on the ring system $$—A—NR^{12}R^{13}$$

where A is a linear or branched chain aliphatic hydrocarbylene group optionally interrupted by one or more hetero atoms, and $R^{12}$ and $R^{13}$ are the same or different and each is independently a hydrocarbyl group containing 9 to 40 atoms optionally interrupted by one or more hetero atoms, the substituents being the same or different and the compound optionally being in the form of a salt thereof. Advantageously, A has from 1 to 20 carbon atoms and is preferably a methylene or polymethylene group. Such compounds are described in WO 93/04148.

Optionally, the additive composition may include a hydrocarbon polymer. Examples of suitable hydrocarbon polymers are those of the general formula

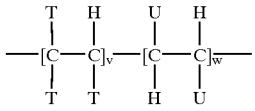

wherein T=H or $R^{14}$ wherein $R^{14}$=$C_1$ to $C_{40}$ hydrocarbyl, and

U=H, T, or aryl and v and w represent mole fractions, v being within the range of from 1.0 to 0.0, w being in the range of from 0.0 to 1.0.

Examples of hydrocarbon polymers are disclosed in WO 91/11488.

Preferred copolymers are ethylene α-olefin copolymers, having a number average molecular weight of at least 30,000. Preferably the α-olefin has at most 28 carbon atoms. Examples of such olefins are propylene, 1-butene, isobutene, n-octene-1, isooctene-1, n-decene-1, and n-dodecene-1. The copolymer may also comprise small amounts, e.g., up to 10% by weight, of other copolymerizable monomers, for example olefins other than α-olefins, and non-conjugated dienes. The preferred copolymer is an ethylene-propylene copolymer.

The number average molecular weight of the ethylene α-olefin copolymer is, as indicated above, preferably at least 30,000, as measured by gel permeation chromatography (GPC) relative to polystyrene standards, advantageously at least 60,000 and preferably at least 80,000. Functionally no upper limit arises but difficulties of mixing result from increased viscosity at molecular weights above about 150,000, and preferred molecular weight ranges are from 60,000 and 80,000 to 120,000.

Advantageously, the copolymer has a molar ethylene content between 50 and 85 per cent. More advantageously, the ethylene content is within the range of from 57 to 80%, and preferably it is in the range from 58 to 73%; more preferably from 62 to 71%, and most preferably 65 to 70%.

Preferred ethylene-α-olefin copolymers are ethylene-propylene copolymers with a molar ethylene content of from 62 to 71% and a number average molecular weight in the range 60,000 to 120,000; especially preferred copolymers are ethylene-propylene copolymers with an ethylene content of from 62 to 71% and a molecular weight from 80,000 to 100,000.

The copolymers may be prepared by any of the methods known in the art, for example using a Ziegler type catalyst. The polymers should be substantially amorphous, since highly crystalline polymers are relatively insoluble in fuel oil at low temperatures.

Other suitable hydrocarbon polymers include a low molecular weight ethylene-(α-olefin copolymer, advantageously with a number average molecular weight of at most 7,500, advantageously from 1,000 to 6,000, and preferably from 2,000 to 5,000, as measured by vapour phase osmometry. Appropriate α-olefins are as given above, or styrene, with propylene again being preferred. Advantageously the ethylene content is from 60 to 77 molar per cent, although for ethylene-propylene copolymers up to 86 molar per cent by weight ethylene may be employed with advantage.

Optionally, the additive composition may include a polyoxyalkylene compound. Examples are polyoxyalkylene esters, ethers, ester/ethers and mixtures thereof, particularly those containing at least one, preferably at least two, $C_{10}$ to $C_{30}$ linear alkyl groups and a polyoxyalkylene glycol group of molecular weight up to 5,000, preferably 200 to 5,000, the alkyl group in said polyoxyalkylene glycol containing from 1 to 4 carbon atoms. These materials form the subject of EP-A-0 061 895. Other such additives are described in U.S. Pat. No. 4,491,455.

The preferred esters, ethers or ester/ethers are those of the general formula $$R^{15}—O(D)—O—R^{16}$$

where $R^{15}$ and $R^{16}$ may be the same or different and represent (a) n—alkyl—

(b) n—alkyl—CO—

(c) n—alkyl—O—$CO(CH_2)_x$— or
(d) n—alkyl—O—$CO(CH_2)_x$—CO— x being, for example, 1 to 30, the alkyl group being linear and containing from 10 to 30 carbon atoms, and D representing the polyalkylene segment of the glycol in which the alkylene group has 1 to 4 carbon atoms, such as a polyoxymethylene, polyoxyethylene or polyoxytrimethylene moiety which is substantially linear; some degree of branching with lower alkyl side chains (such as in polyoxypropylene glycol) may be present but it is preferred that the glycol is substantially linear. D may also contain nitrogen.

Examples of suitable glycols are substantially linear polyethylene glycols (PEG) and polypropylene glycols (PPG) having a molecular weight of from 100 to 5,000, preferably from 200 to 2,000. Esters are preferred and fatty acids containing from 10–30 carbon atoms are useful for reacting with the glycols to form the ester additives, it being preferred to use a $C_{18}$–$C_{24}$ fatty acid, especially behenic acid. The esters may also be prepared by esterifying polyethoxylated fatty acids or polyethoxylated alcohols.

Polyoxyalkylene diesters, diethers, ether/esters and mixtures thereof are suitable as additives, diesters being preferred for use in narrow boiling distillates, when minor amounts of monoethers and monoesters (which are often formed in the manufacturing process) may also be present. It is preferred that a major amount of the dialkyl compound be present. In particular, stearic or behenic diesters of polyethylene glycol, polypropylene glycol or polyethylene/polypropylene glycol mixtures are preferred.

Other examples of polyoxyalkylene compounds are those described in Japanese Patent Publication Nos. 2-51477 and 3-34790, and the esterified alkoxylated amines described in EP-A-117,108 and EP-A-326,356.

The additive composition of the invention is advantageously employed in a proportion within the range of from 0.0001% to 1%, advantageously 0.0005% to 0.075%, and preferably from 0.001 to 0.05%, by weight, based on the weight of fuel oil.

The additive composition of the invention may also be used in combination with one or more other coadditives such as known in the art, for example the following: detergents, particulate emission reducers, storage stabilizers, antioxidants, corrosion inhibitors, dehazers, demulsifiers, antifoaming agents, cetane improvers, cosolvents, package compatibilizers, and lubricity additives.

Additive concentrates according to the invention advantageously contain between 3 and 90%, preferably between 10 and 75%, of the active ingredients of the composition in a fuel oil or a solvent miscible with fuel oil.

The following Examples, in which all parts and percentages are by weight, illustrate the invention.

The fuels used are shown in Table 1 below.

TABLE 1

| Distillation Data ASTM D86, ° C. | Fuel 1 | Fuel 2 | Fuel 3 | Fuel 4 | Fuel 5 |
|---|---|---|---|---|---|
| IBP | 173 | 156 | 161 | 176 | 171 |
| 10% | 207 | 198 | 206 | 223 | 204 |
| 20% | 232 | 227 | 233 | 241 | 223 |
| 30% | 250 | 254 | 256 | 258 | 242 |
| 40% | 270 | 273 | 273 | 273 | 259 |
| 50% | 285 | 288 | 288 | 287 | 276 |
| 60% | 303 | 303 | 302 | 302 | 292 |

TABLE 1-continued

| Distillation Data ASTM D86, ° C. | Fuel 1 | Fuel 2 | Fuel 3 | Fuel 4 | Fuel 5 |
|---|---|---|---|---|---|
| 70% | 323 | 319 | 317 | 318 | 310 |
| 80% | 345 | 340 | 334 | 336 | 331 |
| 90% | 380 | 367 | 354 | 360 | 359 |
| 95% | 399 | 386 | 369 | 378 | 381 |
| FBP | 400 | 389 | 374 | 388 | 392 |
| 90%-20% | 148 | 140 | 121 | 118 | 136 |
| FBP-90% | 20 | 22 | 20 | 28 | 33 |
| Cloud Point, ° C. | +11 | +4 | +2 | +3 | +2 |
| CFPP, ° C. | +7 | 0 | 0 | −3 | −3 |

Additives

Additive A is an example of an oil-soluble hydrogenated block diene polymer:

Additive A is a diblock copolymer of molecular weight 8500, made up of a polyethylene block of molecular weight 1500 and a poly(ethylene-propylene) block of molecular weight 7000.

Additives B, C and D are examples of ethylene-unsaturated ester compounds:

Additives B and C are ethylene-vinyl acetate (EVA) copolymers, including 28–37% by weight vinyl acetate, Mn 3,000–4,000 (by GPC against a polystyrene standard) and linearity of 4 to 5 $CH_3/100CH_2$;

Additive D is an ethylene-vinyl acetate copolymer, including 13.5% by weight vinyl acetate, Mn 6500 (by GPC against a polystyrene standard) and linearity of 7–8 $CH_3/100CH_2$.

Additives E and F are examples of comb polymers:

Additive E is a dialkyl fumarate-vinyl acetate copolymer, including a single $C_{14}$ n-alkyl chain length, vinyl acetate: fumarate molar ratio between 0.7:1 and 1.3:1; and Additive F is a dialkyl fumarate-vinyl acetate copolymer, including a mixed $C_{14/16}$ n-alkyl chain length, vinyl acetate: fumarate molar ratio between 0.7:1 and 1.3:1.

All additives were dissolved in HAN 8080 (except Additive A which was dissolved in Exxsol D100) prior to blending. The additives were blended in a single stage at 55° C. for 30 minutes. The appropriate treat rate of dilute additive package was used in the examples below to obtain the quoted active ingredient treat rates.

In the examples below, the test designated CFPP test was carried out in accordance with the procedure described in "Journal of the Institute of Petroleum", 52 (1966), 173. The quoted CFPP values are the average of at least 2 tests.

EXAMPLE 1

In this example, CFPP testing was carried out for Fuels 1 to 3 treated with a combination of an ethylene-unsaturated ester and a comb polymer. CFPP testing was also carried out for Fuels 1 to 3 treated with a combination of ethylene-unsaturated ester, a comb polymer and a hydrogenated block diene polymer.

| | Component ppm active matter | | | | | | | |
|---|---|---|---|---|---|---|---|---|
| Fuel | Additive A | Additive B | Additive C | Additive D | Additive E | Additive F | Total ppm | CFPP ° C. |
| 1 | 9 | | 55 | | 5 | 9 | 78 | −2 |
| | | 48 | | 16 | 5 | 9 | 78 | +1 |
| | 11 | | 65 | | 6 | 11 | 93 | −4 |
| | | 58 | | 18 | 6 | 11 | 93 | −1 |
| 2 | 23 | | 137 | | 12 | | 172 | −14 |
| | | 120 | | 40 | 12 | | 172 | −7 |
| 3 | 11 | | 69 | | 6 | | 86 | −12 |
| | | 60 | | 20 | 6 | | 86 | −9 |

The results show a significant increase in CFPP depressant effectiveness for the combination of ethylene-unsaturated ester, a comb polymer and a hydrogenated block diene polymer. This means that lower treat rates of this combination can be used to achieve a required target CFPP.

EXAMPLE 2

In this example, Fuels 4 and 5 were treated with a combination of a hydrogenated block diene polymer and an ethylene-unsaturated ester compound. Fuels 4 and 5 were also treated with a combination of a hydrogenated block diene polymer, an ethylene-unsaturated ester compound and a comb polymer.

| | Component ppm active matter | | | | | | |
|---|---|---|---|---|---|---|---|
| Fuel | Additive A | Additive B | Additive C | Additive D | Additive E | Total ppm | CFPP ° C. |
| 4 | 8 | | 46 | | 4 | 58 | −11 |
| | 9 | | 49 | | | 58 | −9 |
| 5 | 8 | | 46 | | 4 | 58 | −13 |
| | 9 | | 49 | | | 58 | −8 |

The results show a significant decrease in CFPP at a given treat rate using the combination of a hydrogenated block diene polymer, an ethylene-unsaturated ester compound and a comb polymer, when compared to the use of the combination of a hydrogenated block diene polymer and an ethylene-unsaturated ester compound. The combination of a hydrogenated block diene polymer, an ethylene-unsaturated ester compound and a comb polymer is therefore far more effective in reducing CFPP than the combination of a hydrogenated block diene polymer and an ethylene-unsaturated ester compound. This means that an additive package including a hydrogenated block diene polymer, an ethylene-unsaturated ester compound and a comb polymer can be used at a lower treat rate to achieve a target CFPP for a given fuel.

What is claimed is:

1. A fuel oil composition containing 0.001 to 1% by weight, based on the weight of fuel oil of an additive composition comprising:

(i) at least one oil-soluble hydrogenated block diene polymer, comprising at least one crystallizable block, obtainable by end-to-end polymerization of a linear diene, and at least one non-crystallizable block, the non-crystallizable block being obtainable by 1,2-configuration polymerization of a linear diene, by polymerization of a branched diene, or by a mixture of such polymerizations;

(ii) at least one ethylene-unsaturated ester compound; and (iii) at least one comb polymer.

2. The fuel oil composition of claim 1, wherein the hydrogenated block copolymer contains at least one crystallizable or crystalline block and at least one non-crystallizable or non-crystalline block.

3. The fuel oil composition of claim 1 or claim 2, wherein the hydrogenated block copolymer is obtainable by hydrogenation of a block copolymer comprising units derived from butadiene and at least one comonomer of the formula $$CH_2{=}CR^1{-}CR^2{=}CH_2$$

wherein $R^1$ represents a $C_1$ to $C_8$ alkyl group and $R^2$ represents hydrogen or a $C_1$ to $C_8$ alkyl group.

4. The fuel oil composition of claim 3, wherein the comonomer contains from 5 to 8 carbon atoms.

5. The fuel oil composition of claim 3, wherein the comonomer is isoprene.

6. The fuel oil composition of claim 1, wherein the molecular weight, Mw, measured by GPC, of component (i) is within the range of 500 to 100,000.

7. The fuel oil composition of claim 6, wherein the molecular weight is within the range of 500 to 20,000.

8. The fuel oil composition of claim 7, wherein the molecular weight is within the range of 500 to 10,000.

9. The fuel oil composition of claim 1, wherein the hydrogenated block copolymer is a diblock copolymer comprising a crystalline block and noncrystalline block, the molecular weight of the crystalline block being from 500 to 20,000 and that of the non-crystalline block from 500 to 50,000.

10. The fuel oil composition of claim 1, wherein at least 90% of the original unsaturation of the block copolymer of component (i) has been removed by hydrogenation.

* * * * *